US006318648B1

(12) United States Patent
Kelly

(10) Patent No.: US 6,318,648 B1
(45) Date of Patent: Nov. 20, 2001

(54) ELECTROSTATIC ATOMIZER BASED MICRO-BURNER FOR LOGISTIC FUELS

(75) Inventor: Arnold J. Kelly, Princeton Junction, NJ (US)

(73) Assignee: Charged Injection Corporation, Monmouth Junction, NJ (US)

( * ) Notice: Subject to any disclaimer, the term of this patent is extended or adjusted under 35 U.S.C. 154(b) by 0 days.

(21) Appl. No.: 09/702,925

(22) Filed: Oct. 31, 2000

Related U.S. Application Data

(62) Division of application No. 09/237,583, filed on Jan. 26, 1999, now Pat. No. 6,161,785.

(60) Provisional application No. 60/072,438, filed on Jan. 26, 1998.

(51) Int. Cl.[7] ..... B05B 15/02; B05B 1/32; B05B 5/00; F24C 1/14

(52) U.S. Cl. ..... 239/708; 239/107; 239/455; 126/9 R

(58) Field of Search ..... 239/104, 106, 239/107, 451, 455, 690, 708, 590, 581.1, 690.1, 706; 126/4, 9 R, 41 R, 40, 100; 431/203, 206, 255, 266, 344

(56) References Cited

U.S. PATENT DOCUMENTS

| | | | | |
|---|---|---|---|---|
| 3,764,255 | * | 10/1973 | Hagel et al. | 431/236 |
| 4,255,777 | * | 3/1981 | Kelly | 239/704 |
| 4,380,786 | | 4/1983 | Kelly | 361/228 |
| 4,581,675 | | 4/1986 | Kelly | 361/228 |
| 4,927,353 | * | 5/1990 | Normura et al. | 431/215 |
| 4,991,774 | * | 2/1991 | Kelly | 239/3 |
| 5,093,601 | | 3/1992 | Watanabe et al. | 313/25 |
| 5,093,602 | | 3/1992 | Kelly | 313/231.01 |
| 5,378,957 | | 1/1995 | Kelly | 313/231.01 |
| 5,391,958 | | 2/1995 | Kelly | 313/420 |
| 5,478,266 | | 12/1995 | Kelly | 445/43 |
| 5,515,681 | | 5/1996 | DiFreitas | 60/740 |
| 5,531,066 | * | 7/1996 | Pfefferle et al. | 60/39.822 |
| 5,628,180 | | 5/1997 | DeFreitas | 60/39.06 |
| 5,695,328 | | 12/1997 | DeFreitas et al. | 431/268 |

* cited by examiner

*Primary Examiner*—Kevin Shaver
*Assistant Examiner*—Davis Hwu
(74) *Attorney, Agent, or Firm*—Lerner, David, Littenberg, Krumholz & Mentlik, LLP

(57) ABSTRACT

An electrostatic atomizer is disclosed, which includes an electrode or other charge injection device and a source of liquid for passing a stream of liquid past the charge injection device to a variable orifice. The variable orifice is defined between at least two elements, which are movable with respect to each other. A compact stove incorporating the atomizer includes a support for supporting articles to be heated by the burning of atomized fuel. The variable orifice may be used in the stove to control the flow, and therefore thermal output, of the stove.

23 Claims, 7 Drawing Sheets

ELECTROSTATIC ATOMIZER BASED MICRO-BURNER FOR LOGISTIC FUELS

CROSS-REFERENCE TO RELATED APPLICATIONS

This application is a divisional of U.S. patent application Ser. No. 09/237,583, filed Jan. 26, 1999 now U.S. Pat. No. 6,161,785 the disclosure of which is hereby incorporated by reference herein. This application claims benefit of U.S. Provisional Application Ser. No. 60/072,438, filed Jan. 26, 1998, the disclosure of which is hereby incorporated by reference herein.

FIELD OF THE INVENTION

The present invention relates to electrostatic atomizers and, in particular, electrostatic atomizers for fuel and combustion devices for burning atomized fuel.

BACKGROUND OF THE INVENTION

Electrostatic atomizers for producing atomized liquids are known. Electrostatic atomizing devices for atomizing a liquid having low conductivity are disclosed in U.S. Pat. Nos. 4,255,777, 4,380,786, 4,581,675, 4,991,774, and 5,093,601 to Kelly, the disclosures of which are hereby incorporated by reference herein. The electrostatic atomizer of U.S. Pat. No. 4,255,777 is capable of forming droplets having an average diameter of less than about 1 millimeter for a liquid having a low conductivity. Using an electrostatic atomizer like that of U.S. Pat. No. 4,255,777, hydrocarbon fuels can be efficiently burned in a combustion device because the atomizer can produce droplets of fuel of such a small size. Fuels which are challenging to burn can be atomized with a sufficient flow rate for a compact combustion device utilizing such an atomizer.

A combustion device using an electrostatic atomizer is disclosed by U.S. Pat. No. 5,695,328 to DeFreitas et al., the disclosure of which is hereby incorporated by reference herein. This patent discloses an ignition device useful for engine combustors in which the electrostatic atomizer of U.S. Pat. No. 4,255,777 may be used. In this device, the voltage is varied to vary the fuel droplet size produced by the atomizer and to thereby vary the thermal output for the device.

In electrostatic atomization according to the aforementioned patents and patent applications, electrical charges from an electrode are injected into the fluid to be atomized, so that the fluid has a net charge, typically a negative charge. Fuel droplets are formed in the above-discussed electrostatic atomizers under the influence of electrostatic forces within the fluid. The size of the fuel droplets produced is independent of the flow rate. Droplet sizes which are a fraction of the orifice diameter can be produced. Thus, details of the orifice cross-section, such as the geometry of the orifice and its alignment with the emitter, do not affect the atomizer's ability to produce a regularly shaped plume of self-dispersed fuel. In certain atomizers according to U.S. Pat. Nos. 5,093,602, 5,378,957, 5,391,958, and 5,478,266 of Kelly, the disclosures of which are also hereby incorporated by reference herein, a charge is injected onto the fluid using an electron beam. These designs provide similar atomization.

It would be desirable to provide an electrostatic atomizer and a combustion device incorporating an electrostatic atomizer having an orifice design which exploits the fact that the orifice design and flow rate are independent of the atomization of the liquid.

SUMMARY OF THE INVENTION

The present invention addresses these needs.

An electrostatic atomizer in accordance with one aspect of the present invention comprises a body having a downstream end and including a plurality of orifice elements defining a variable orifice at the downstream end, charge-providing means disposed in the body, and means for passing a stream of liquid past the charge-providing means to the downstream end so that a net charge is applied to the liquid and a stream of atomized liquid is discharged from the variable orifice, the liquid being atomized at least partially under the influence of the net charge, and the variable orifice being openable and closeable to control the flow of the stream of atomized liquid.

This aspect of the invention exploits the fact that atomization under the influence of a net charge injected into the fluid is independent of the shape and size of the orifice. within extremely broad limits. Thus, varying the orifice geometry opening to control the flow rate does not impair the atomization. The preferred atomizers according to this aspect of the invention can provide reliable atomization over a broad range of flow rates. Moreover, because the same elements which define the atomizing nozzle also provide variable control of the flow rate, there is no need for separate flow-control devices, making the entire structure simple and economical.

Because the droplet size is independent of the orifice geometry, a number of orifice designs can be used. In theory, any shape for a three-dimensional orifice may be used. For instance, the orifice may be a triangular orifice, conically-shaped orifice, a slit orifice, a circular or a scalloped circular orifice. This is particularly useful in small scale combustion devices, in which extremely small orifices must be provided. For small scale combustion systems, the ability to use small components affects the portability and feasibility of the combustion device. The plurality of orifice elements may include a first orifice element and at least one other orifice element slidable across the first orifice element to define the variable orifice. The plurality of orifice elements may include an element having a V-shaped edge.

The first orifice element may comprise a surface defining a hole having a first width and the at least one other orifice element may comprise a narrow element disposed across the hole and having a second width less than the first width to define at least one aperture comprising the orifice of the atomizer.

At least one aperture may also be defined by at least one wire disposed across the hole of the aforementioned first orifice element, which may also include at least one groove having a width for receiving the at least one wire. At least one wire may be movable away from the hole in response to the flow of liquid through the orifice so that the variable orifice is flushable with a flow of liquid sufficient to flush the orifice. Thus, clogging of the orifice may be corrected. The plurality of orifice elements may define a variable orifice in the shape of a triangle including a 90° angle, which is preferable because the 90° angle is more easily flushed to remove debris.

The charge-providing means may include a conically-shaped element having a pointed forward end and being disposed in the body so that the forward end points towards the downstream direction, a surface spaced from the conically-shaped element, and a power source. The power source provides a potential difference between the conically-shaped element and the surface so that a net charge may be applied to the liquid. Other charge injection devices may be used to effect the atomization of the fluid. For example, an electron gun may be used to inject the fluid with a net charge, thereby atomizing the fluid.

The plurality of orifice elements may be moveable relative to one another between a minimum flow position in which the orifice elements define a relatively small orifice and a maximum flow position in which the orifice elements define a relatively large orifice. Where the charge-providing means includes the conically-shaped electrode, the orifice elements may be moveable relative to one another so that the orifice of the atomizer is aligned with the conically-shaped electrode. The at least one other orifice element may be slidable across the hole in the first surface of the first orifice element to define the orifice. At least one other orifice element may have a second surface defining a second hole to define the orifice.

The plurality of orifice elements may also include a tubular case so that the other of the plurality of orifice elements are disposed in the tubular case. Thus, the orifice elements including the tubular case may be rotatable relative to one another between the minimum flow position and the maximum flow positions. The plurality of positions of the plurality of orifice elements may include a fully off position in which no orifice is defined and the flow of atomized fuel is prevented.

The electrostatic atomizer may include anti-clogging means so that the orifice may be flushed with a liquid to prevent clogging. The anti-clogging means may include the plurality of orifice elements, where the orifice elements include a flush position in which the orifice is wide open to flush the orifice.

Another aspect of the present invention provides a compact stove comprising an electrostatic atomizer for imparting a charge to a liquid fuel so that the fuel is atomized under the influence of the liquid charge, a fuel source in communication with the atomizer for carrying fuel to the atomizer, and a support disposed above the atomizer for supporting an article to be heated by the stove.

The compact stove may include a housing base and a grid moveable relative to the housing base between a closed position wherein the grid is close to the housing base and a fully opened position wherein the grid is remote from the housing base, the housing base and the grid enclosing the atomizer when the combustion member is in the closed position.

The compact stove may include a catalytic member disposed above the orifice of the atomizer and adapted to catalyze combustion of the fuel. A power source may also be included, which may comprise one or more batteries electrically connected to a voltage converter.

An external fuel source may be used or a pressurized fuel vessel may be disposed in the housing base in communication with the atomizer. The pressurized fuel vessel may include biasing means for applying pressure to the fuel within the vessel. The biasing means may include a latched position to prevent the application of pressure to the fuel so that no fuel flows to the atomizer.

The compact stove may include an atomizer for atomizing the fuel having a variable orifice for controlling the flow of the fuel, as provided above. The atomizer may include a plurality of orifice elements defining a variable orifice and movable relative to one another between a plurality of positions including a minimum flow position in which the orifice elements define a relatively small orifice and a maximum flow position wherein the orifice elements define a relatively large orifice. A control knob may be connected to at least one of the plurality of orifice elements for controlling relative movement of the orifice elements. The control knob may be connected to the power source so that the power source is electrically connected to or disconnected from the atomizer and may also be connected to the biasing means for releasing the biasing means from the latched position.

BRIEF DESCRIPTION OF THE DRAWINGS

These and other features, aspects and advantages of the present invention will become better understood with regard to the following description, appended claims and accompanying drawings where:

BRIEF DESCRIPTION OF THE PREFERRED EMBODIMENT

Figure 4:
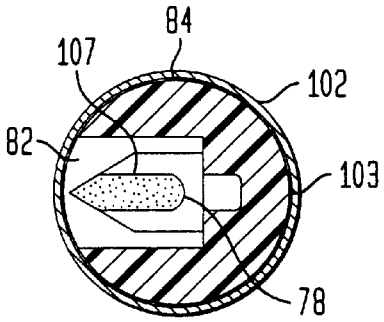
FIG. 4 is a section taken along line 4—4 in FIG. 3.
Figure 5:
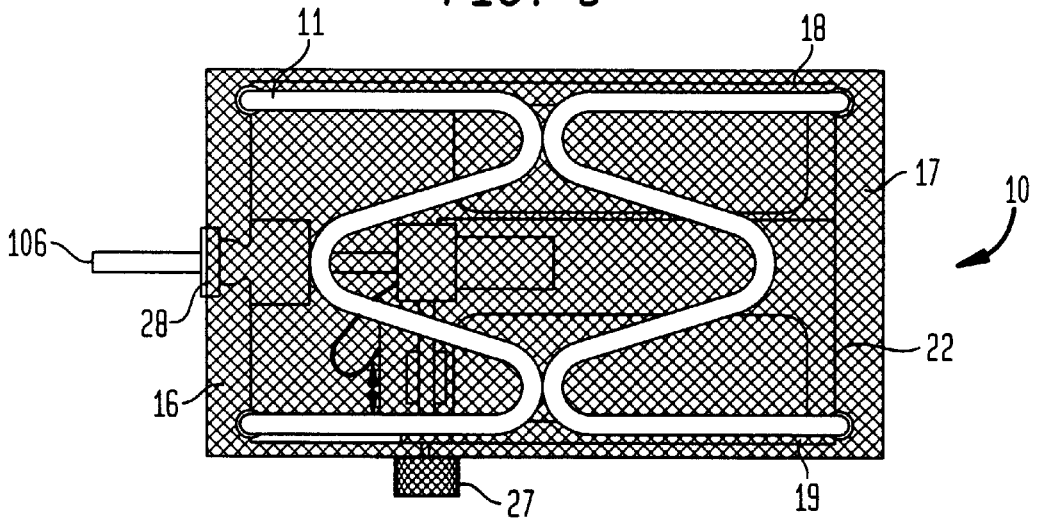
FIG. 5 is a top plan view showing a pocket stove incorporating an atomizer in accordance with the embodiment of FIGS. 1–4.
Figure 6:
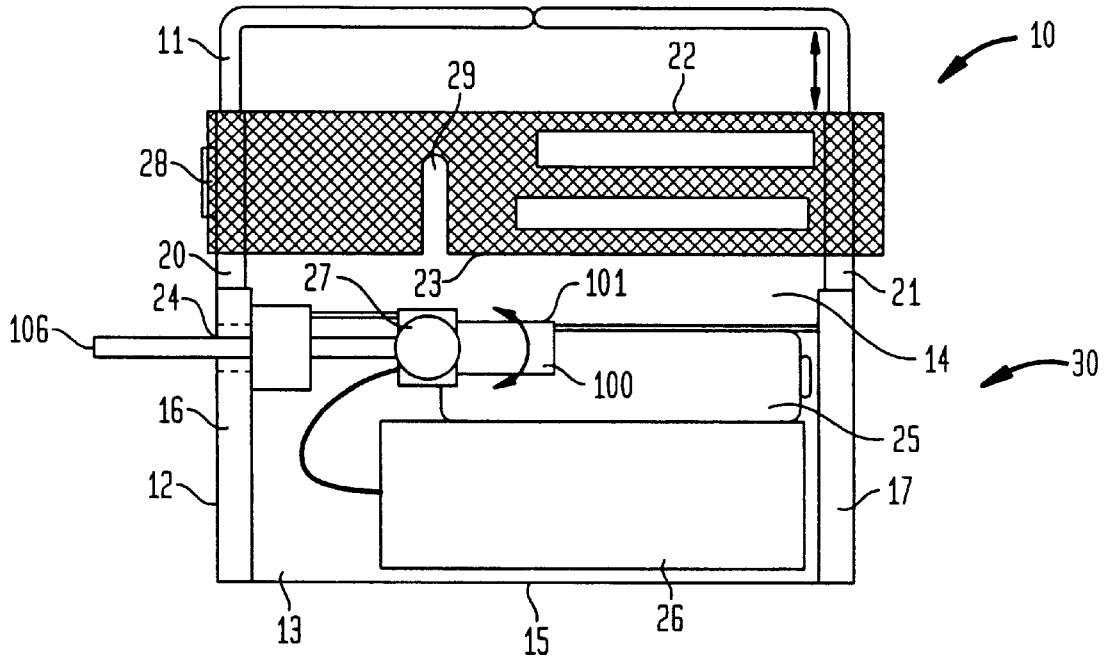
FIG. 6 is a cut-away front elevational view of the pocket stove in accordance with the embodiment of FIGS. 1–5.

A pocket stove in accordance with one embodiment of the present invention is illustrated by FIGS. 1–6. In FIGS. 5 and 6, the pocket stove 10 has a housing base 12, a support 11, a grid 22, a power source 30, a fuel inlet 106, control knob 27, and an electrostatic atomizer 100.

The housing base 12 has a compartment 13 and an open top 14. The compartment is defined by bottom wall 15 and side walls 16, 17, 18 and 19. The housing base also includes an aperture 24 for the inlet 106. At an upper end of side walls 16 and 17 is attached telescoping portions 20 and 21. Telescoping portion 20 slides into a hollow chamber (not shown) within side wall 16 and telescoping portion 21 slides into a hollow chamber (not shown) in side wall 17. A top end of the telescoping portions 20 and 21 are attached to a support 11 for supporting articles to be heated by the stove. Preferably, a grid surface 22 is also attached to the top end of the telescoping portions 20 and 21.

The grid surface has an open position and a closed position for enclosing the components within chamber 13. The grid 22 has an open bottom 23 so that when support 11 is pushed downwardly by the user, telescoping portions 20 and 21 move downwardly into the hollow chambers within side walls 16 and 17 to the closed position. The grid 22 includes a seal 28 for sealing the inlet 106 and a capture slot 29 for the control knob 27. In the closed position, the grid surface 22 surrounds an upper portion of the housing base so that the seal 28 closes off the fuel inlet 106 and the capture slot 29 captures control knob 27. Although the grid surface is not required to produce a flame, the use of a grid surface is preferred to stabilize the flame. Most preferably, the grid is comprised of a catalytic material for producing a cleaner burning flame, which is particularly desirable for a pocket stove used in cooking. A catalytic grid would be a grid of platinum coated ceramic grid, similar to the catalytic converter of a car.

An electrostatic atomizer 100 is provided in the pocket stove to atomize liquid fuel so that the fuel may be easily ignited and efficiently burned. The fuel may be any hydrocarbon fuel and may include fuels which are "heavy" or less volatile and difficult to ignite and burn. Using the electrostatic atomizer of the present invention enables the use of logistic fuels, which are those fuels readily available to military forces, such as diesel fuel, and jet-A fuel to be used as the fuel for the pocket stove, which is a fairly compact unit and convenient for military and other camping purposes. When the grid is in the closed position, the pocket stove in FIGS. 5 and 6 is a 44 mm by 91 mm by 52 mm playing card deck sized unit.

The electrostatic atomizer 100 imparts a net charge to a stream of fuel to electrostatically charge the fuel. A high voltage conductor in contact with the fuel imparts the net charge to the fuel. Once charged, the fuel exits orifice 101 where the electrostatic forces within the fuel cause the fuel to disperse into a plume of droplets of about 20 to 40 mm in diameter.

In this embodiment, the pocket stove includes an external fuel source. A fuel inlet 106 comprises a conduit which extends through an aperture in the housing base and is in communication with the electrostatic atomizer. The fuel source may comprise an external "standard fuel bottle" pressurized to one bar. Preferably, the inlet 106 includes a quick disconnect fitting for attaching the external fuel source. Diesel, jet-A, gasoline, No. 2 heating oil, or other hydrocarbon fuels may be used.

The atomizer includes an elongated, generally cylindrical insulator 104 fixedly mounted to housing base 12. Insulator 104 has an axial bore 80 extending along the central axis 78 of the insulator and communicating with fuel inlet 106. The insulator also has a transverse bore 82 communicating with axial bore 80. Axial bore 80 extends to the circumferential surface 84 of the insulator. As best seen in FIG. 4, a pointed electrode 107 is mounted to insulator 104 in transverse bore 82, so that the tip 108 of the electrode points away from the central axis 78 of the insulator. Transverse bore 82 is slightly larger in diameter than electrode 107, so that there is a clearance around the electrode. Although the present invention is not limited to any particular dimensions, in a typical atomizer suitable for use in a pocket stove, insulator 104 has an exterior diameter of about 1.5 mm.

The atomizer further includes an inner tubular metallic sleeve element 103 coaxial with insulator 104 and closely overlying the circumferential surface 84 of the insulator. The wall of inner sleeve element 103 has a V-shaped notch 117 extending through it. Notch 117 has a narrow end 86 tapering to a point and widens progressively in a first circumferential direction 113, from narrow end 86 to a wide end 88. Sleeve element 103 is fixedly mounted on insulator 104 with the narrow end 86 of the notch aligned with electrode 107 and tip 108. The included angle between the edges of the notch typically is about 90 degrees, although lesser or greater angles can be used. The dimension of the notch in the circumferential direction typically is a few mm.

Figure 1:
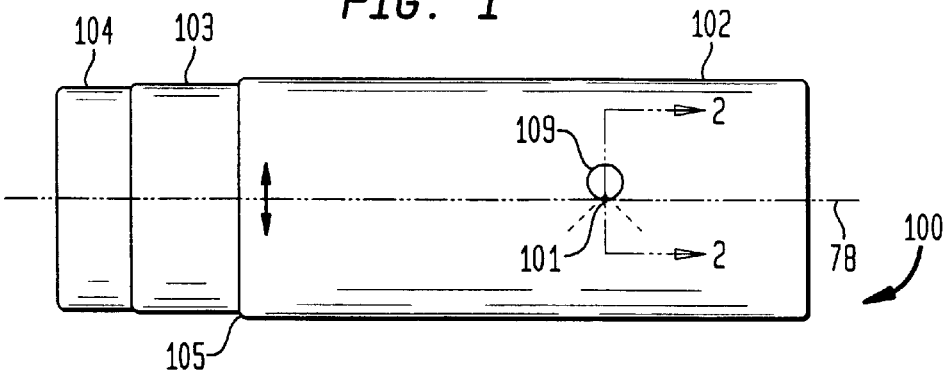
FIG. 1 is a top plan view of an electrostatic atomizer in accordance with a first embodiment of the invention.
Figure 1A:
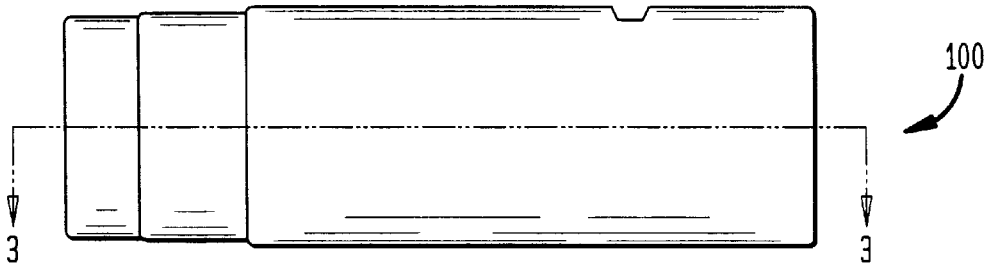
FIG. 1A is a front elevational view of the electrostatic atomizer of FIG. 1.
Figure 2:
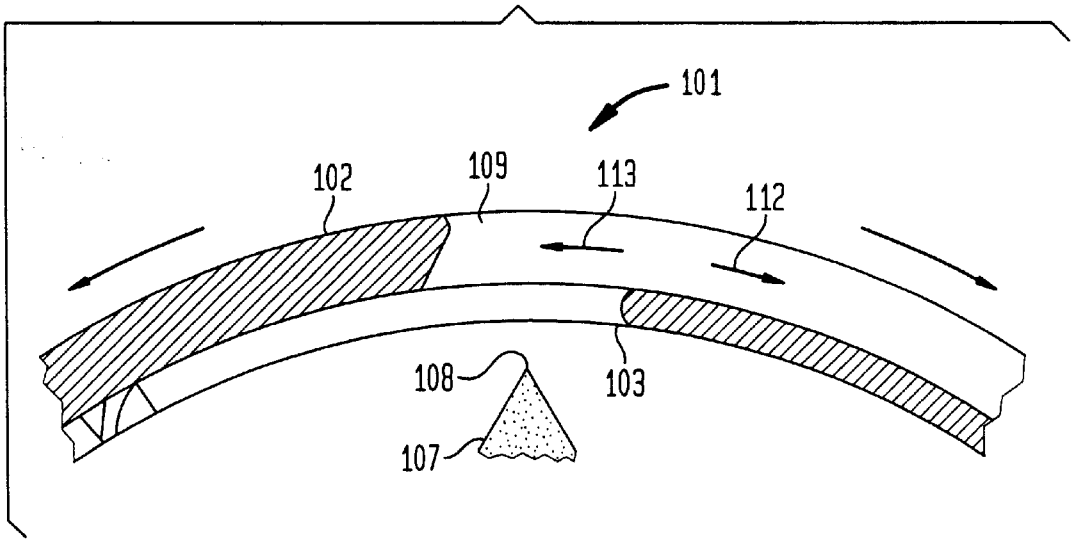
FIG. 2 is a section taken along line 2—2 in FIG. 1.
Figure 2A:
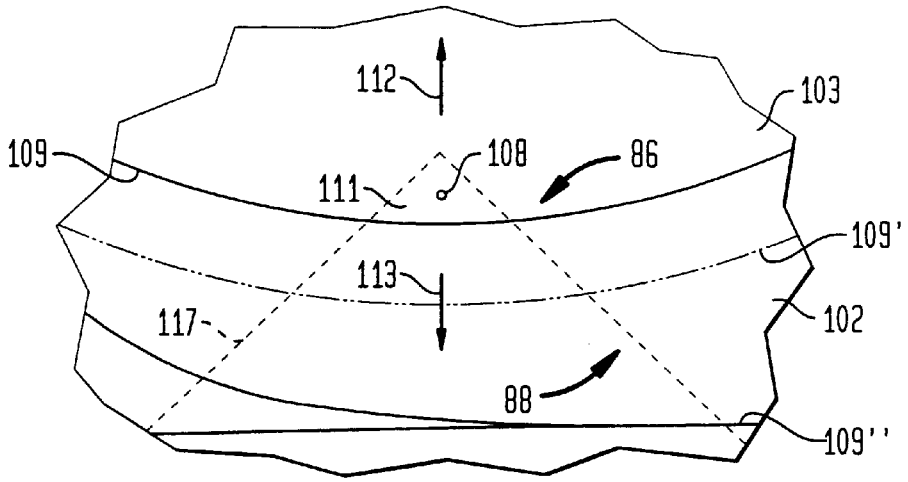
FIG. 2A is a detail of the orifice of the atomizer of FIGS. 1–2.
Figure 3:
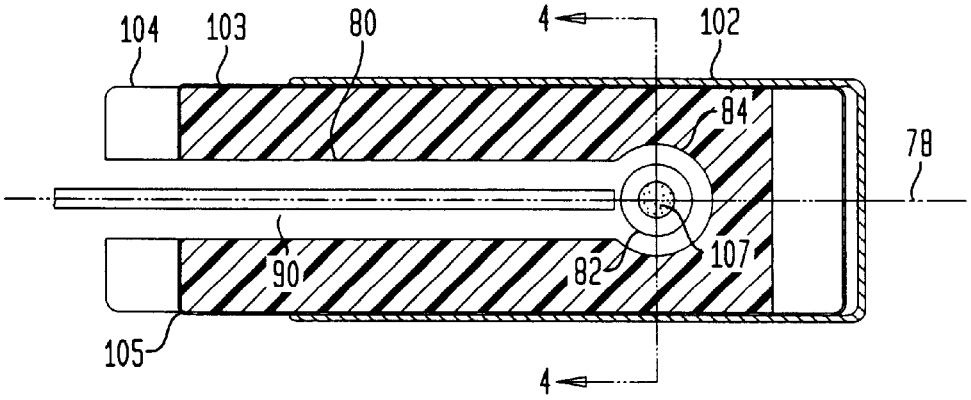
FIG. 3 is a section taken along line 3—3 in FIG. 1A.

A rotary case or outer tubular metallic sleeve element 102 overlies the exterior circumferential surface of the inner sleeve element 103. Outer sleeve element 102 is also coaxial with the inner sleeve element 103 and insulator 104. The outer sleeve element has a hole 109 extending through its wall. Merely by way of example, hole 103 may be about 1 mm in diameter. The rotary case or outer sleeve element 102 is rotatable around the common central axis 78 of the insulator and inner sleeve. In a full off position, hole 109 is out of alignment with V-shaped notch 117, so that the inner and outer sleeves cooperatively close transverse bore 82. Movement of the outer sleeve 102 in the first circumferential direction 113 from the full off position brings the edge of hole 109 into alignment with a part of notch 117, at the narrow end 86, so that the hole and notch cooperatively define a small orifice 111 (FIG. 2*a*) in alignment with the transverse bore 82 and in alignment with the electrode tip 108. Further rotational movement of the outer sleeve in the first direction 113 causes the outer sleeve and the edge of hole 109 to move to the maximum orifice position shown in broken lines at 109' in FIG. 1A. In this condition, the hole 109 and notch 117 cooperatively define a larger orifice. Thus, rotational movement of the outer sleeve relative to the inner sleeve can vary the size of orifice 111, or entirely occlude such orifice. Still further rotational movement of the outer sleeve in the first direction brings the hole to the flush position shown in broken lines at 109 in FIG. 2A. In this position, the hole uncovers a still larger portion of notch 117. As further discussed below, this position, in which the size of orifice 117 is even larger than at the maximum position. is used for flushing the system of contaminants. Electrode 107 is electrically connected by a lead 90, disposed within axial bore 80, to the negative high voltage output of a DC-DC voltage converter 26. Merely by way of example, voltage converter 26 may be a conventional converter of the type sold under the designation E121CT by the EMCO High Voltage, Inc. 11126 Ridge Road, Sutter Creek, Calif. 95685. The converter desirably is arranged within the housing base 12 to provide a high voltage output of about 5–25 kilovolts, and more preferably 1–15 kilovolts, at a few microamperes or less high voltage current flow. The positive high voltage output of the converter is connected to the inner metallic sleeve 103. The voltage converter is connected to battery power source 25. The battery power source 25 preferably comprises three "AA" batteries 25 provided within the compartment 13 of the housing base 12. The pocket stove may also comprise a device for connection to an external power source. For example, the pocket stove in this alternative would include a plug for connection to an AC power source and an AC-DC converter. Alternatively, the power source can include a plug for connecting to an automobile cigarette lighter socket, or other external portable power source. A control knob 27 is connected to the power supply 30 for disconnecting the battery or batteries from the voltage converter, effectively shutting off the power to the atomizer. The control knob is also connected to the rotary case 102 through a rotary drive linkage so that rotation of the control knob causes rotation of the case 102. Any conventional rotary drive may be employed as, for example, mating bevel gears, belts, friction drives, or a worm gear on the control knob in mesh with a gear on case 102. The control knob has an off position, in which the orifice 101 is in 15 the fully off position as discussed above. In the off position of the control knob, the control knob is adjacent the side wall of the housing base 12. The control knob also has an operating position in which the knob is rotatable to vary the relative positions of the orifice elements 102 and 103 as discussed above. To move the knob into the operating position, the user of the pocket stove pulls the knob axially outwardly. The control knob has a further, flush position and a spring (not shown) for flushing the orifice with unatomized fuel. Pulling the control knob outwardly away from the housing base against the bias of the spring causes the power supply 30 to be electrically disconnected from the atomizer so that the orifice of the atomizer is flushed with fuel. Preferably, the control knob also moves the orifice elements 102 and 103 to a position in which they define an aperture 111 larger than that of the maximum flow position to ensure that debris is fully expunged from the orifice. Thus, element 102 is moved in the direction 113 50 that the edge of the aperture 109" defines a larger aperture 111, in FIG. 2A.

Before use, the control knob is in an off position and captured by the capture slot 29 in grid 22. The rotary case 102 is in an off position so that the aperture 109 is located over the sleeve 103, out of alignment with V-notch 117, and no aperture 111 for the orifice 101 is formed. The battery or batteries are disconnected from the power supply 26 so that the electrostatic atomizer receives no power for electrode 107. A pressurized external fuel source is connected to inlet 106. The user then pulls upwardly on the support 11 so that telescoping portions 20 and 21 extend upwardly from side walls 16 and 17. Capture slot 29 is moved away from control knob 27 and inlet cover 28 is moved away from inlet 106. At this time, a lit match may be placed on the grid 22 for igniting the fuel about to be atomized.

The control knob is pulled outwardly to the operating position. This action rotates the case 102 of the electrostatic atomizer 100 in the direction 113 so that aperture 109 and notch 110 form an aperture 111 for the orifice 101. At the same time, the battery or batteries 25 are connected to power supply 26. Fuel travels from inlet 106 into the axial bore 80 of the electrostatic atomizer 100 downstream to the electrode 107. The fuel flows past electrode 107 to receive a net charge. The charged fluid travels through aperture 111 of the orifice 101 and is atomized at least partially under the influence of the net charge. A plume of fuel droplets sprays upwardly out of orifice 101 towards grid 22 and is ignited by the lit match on the grid. The control knob 27 is rotatable to control the flow of the fuel and the thermal output for the pocket stove. As the control knob is turned, the rotary case 102 turns in either direction 113 or 112 to define a smaller or larger aperture 111, respectively. Pulling the control knob outwardly past the operating position disconnects the battery or batteries from the high voltage power supply and delivers a volume of fuel to the orifice which is sufficient to flush out debris which may clog the orifice. Releasing the control knob returns it to the operating position.

After use, the control knob is pushed inwardly towards the housing base 12. The battery or batteries 25 are disconnected from the voltage converter 26 and the orifice 101 of the electrostatic atomizer 100 is closed by rotating the case 102 in direction 112. As the user pushes downwardly on support 11 to close the stove, capture slot 29 holds the control knob in the off position, and inlet cover 28 closes off inlet 106.

Other anti-clogging techniques are disclosed in pending U.S. provisional patent application filed on Dec. 31, 1998 by Arnold J. Kelly, entitled Improvements in Electrostatic Atomizers, the disclosure of which is incorporated by reference herein. Certain atomizers taught in this application are designed to prevent buildup of debris within the electrostatic atomizer. Atomizers according to this application may also include multiple orifices. The atomizers taught in this application may be used in the present stove. The above discussed pocket stove may also include the electrostatic atomizers of U.S. provisional patent application Nos. 60/106,421 and 60/106,420, each filed Oct. 30, 1998, by Kelly, both of which are hereby incorporated by reference herein.

Figure 7:
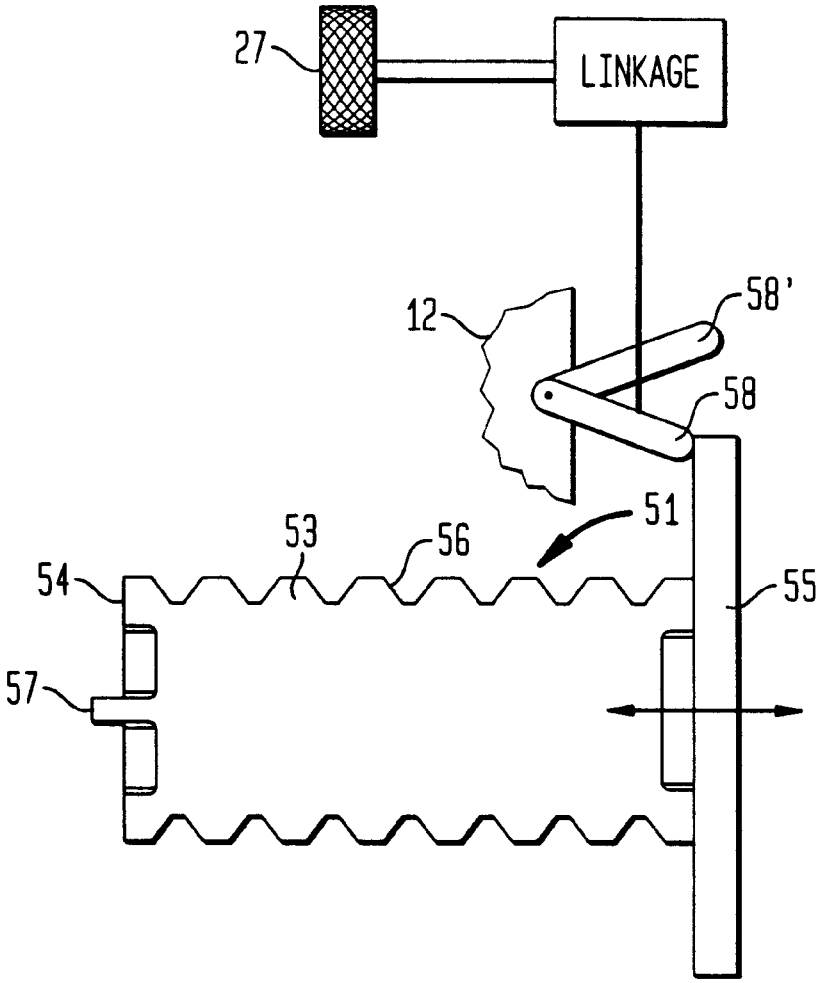
FIG. 7 is a top plan view of a pressurized fuel vessel for the pocket stove in accordance with another embodiment.
Figure 8:
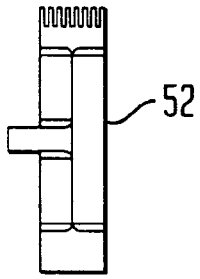
FIG. 8 is a top plan view of the pressurized fuel vessel of FIG. 7 in a different position.

A number of other charge injection devices may be used in the electrostatic atomizer of the present invention. An electron gun may be used, as discussed above. Although the electrode discussed above is conically-shaped, electrodes having various designs may also be used. Formed of a series of pins may be used. An electrode comprising a surface of negative electron affinity material, such as diamond may be used as the electrode. In another embodiment, the pocket stove is provided with a pressurized fuel vessel disposed within the housing base 12. Pressurized fuel vessel 50 is shown in FIGS. 7 and 8. To accommodate the pressurized fuel vessel, only one AA battery 25 is provided in the pocket stove and the vessel 50 takes the place of the missing two AA batteries, as only one AA battery is actually required for operation.

As seen in FIGS. 7 and 8, the vessel 50 has an extended position 51 and a collapsed position 52. In the extended position 51. liquid fuel fills the compartment 53 formed by ends 54 and 55 and collapsible material 56. In the vessel of FIGS. 7 and 8, a volume of 26,000 cubic mill is provided in the expanded position. An outlet 57 is provided at one end 54 of the vessel 50 for connection with the atomizer 100. The vessel 50 also includes a biasing means for pressurizing the vessel 50, in a manner known in the art. In FIG. 7, the biasing means comprises a bellows of metallic material with sufficient resilience to apply one bar of pressure. Thus, the biasing means may be integral with collapsible material 56. The biasing means preferably applies 45 N or about 10 LB of force to provide the vessel with the one bar of desired pressure for operation. In the alternative, a separate spring may be provided. The vessel 50 has a latched position in which the biasing means or spring does not apply pressure to the vessel 50. To this end, a latch 58 is attached to the control knob. In the latched position 58, end 55 is prevented from applying pressure and fuel will not flow through outlet 57. The biasing means may also comprise a spring having an integral winding key extending to the exterior of the housing base 12 so that the user of the pocket stove may prepare the pocket stove for operation. The control knob 27 is connected to the latch 58 for releasing the biasing means from the latched position 58 when the control knob is moved into the operating position. Thus, the latch 58 is connected to knob 27 via a linkage including a string, chain, actuator, rod, or similar devices known in the art.

Prior to operation, the vessel 50 is in a latched position in which 15 latch 58 prevents end 55 from applying pressure to fuel. If a winding key is provided, the user may wind the spring using the winding key to apply pressure to the vessel in preparation for operation of the stove. The support 11 is extended upwardly by the user. The control knob is pulled outward to its operating position, preparing the atomizer 100 for operation as discussed above. The control knob interacts with the biasing means or spring to release the vessel from its latched position. After use, when the control knob is pushed inwardly, the vessel 50 becomes latched to remove pressure from the vessel 50 so that fuel does not flow to the atomizer.

Variable orifices may be formed using elements having shapes other than the V-shaped notch and circular aperture. In a third embodiment, the orifice 101 is formed by an element 150 having a hole 151 formed therein, a longitudinal groove 152 extending from the hole in a first direction, and a groove 153 extending from the hole in a second direction. Within the grooves 152 and 153 is disposed a wire 154. The wire has a first end 155 and a second end 156. Either of ends 155 and 156 is anchored to element 150 and the other of ends 155 and 156 remains unanchored to element 150.

Figure 9:
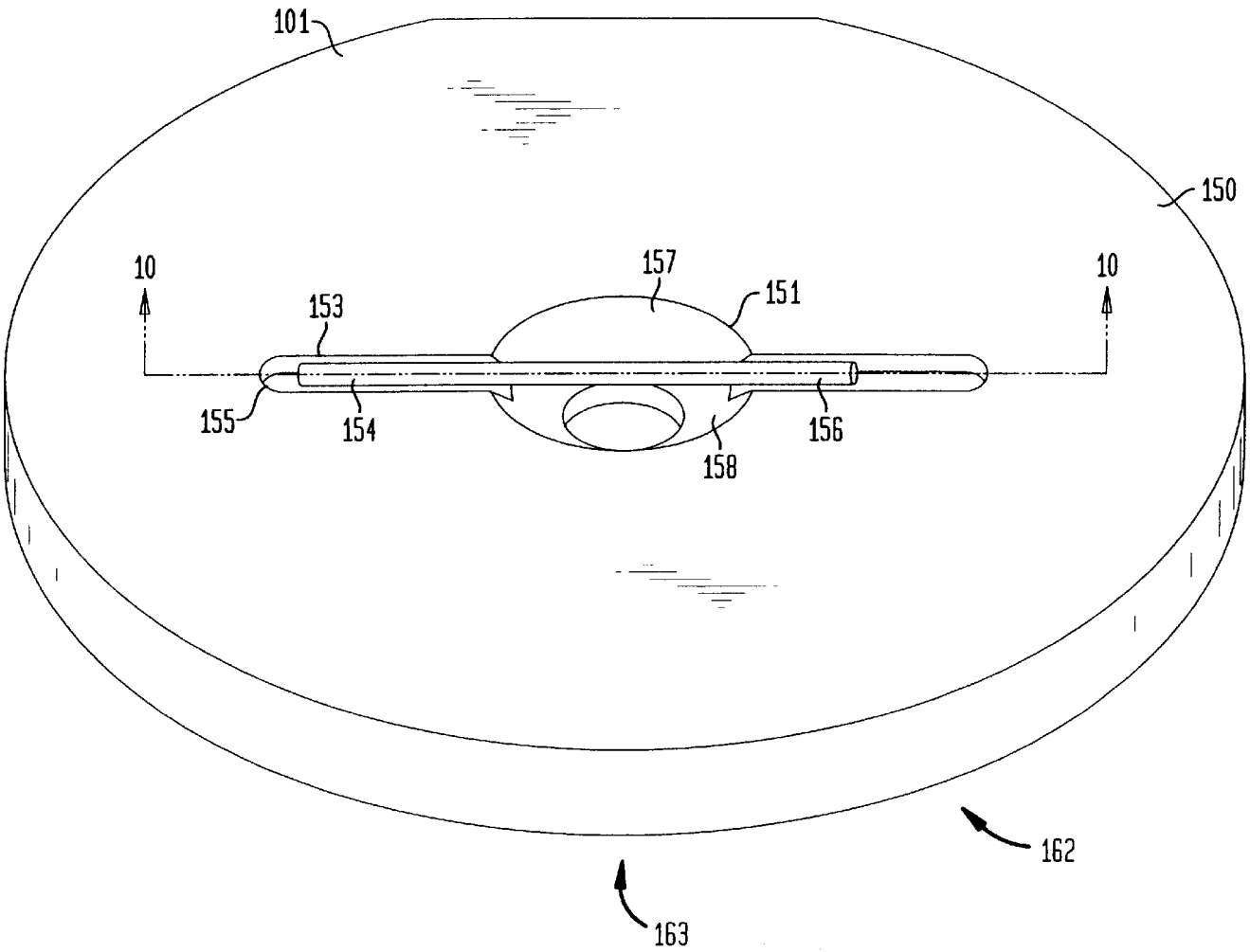
FIG. 9 is a top perspective view of an orifice of an electrostatic atomizer in accordance with yet another embodiment.
Figure 10:
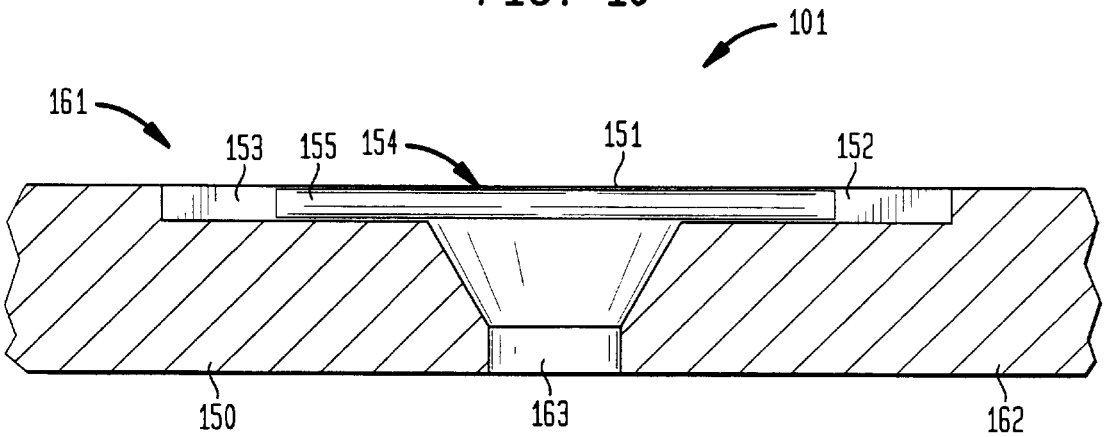
FIG. 10 is a sectional view taken along line 10—10 in FIG. 9.
Figure 11A:
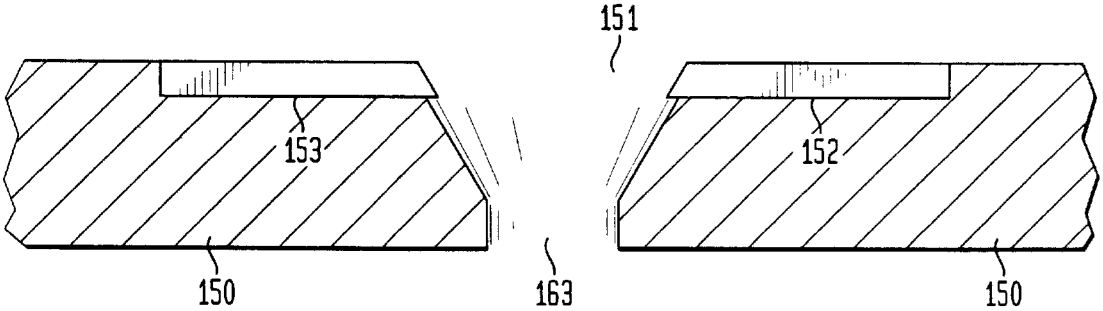
FIG. 11A is a sectional view taken along line 11*a*–11*a* in FIG. 11.
Figure 11:
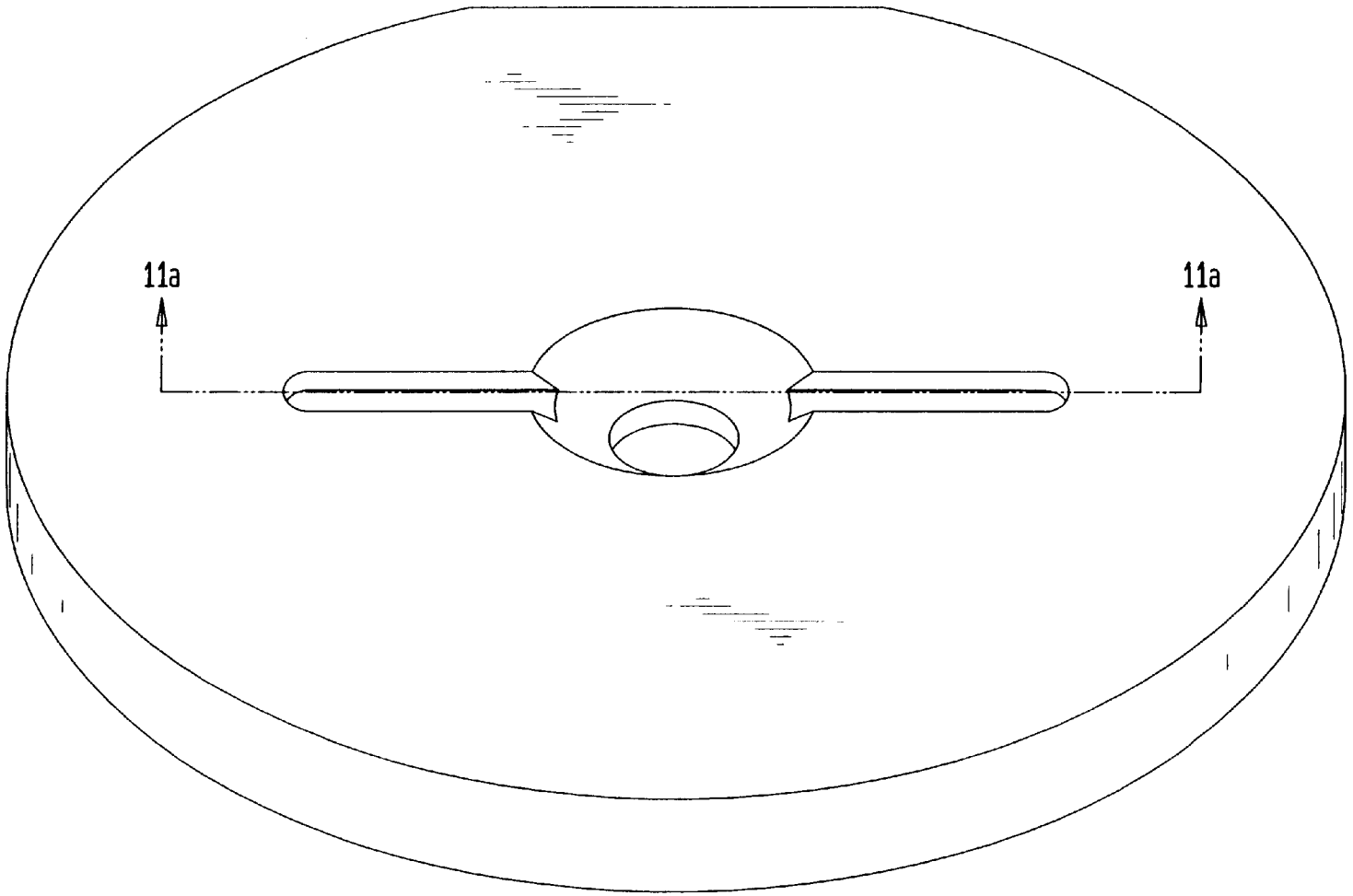
FIG. 11 is a top plan view of a first orifice element in accordance with the embodiment of FIGS. 9–10.

The element 150 of FIGS. 9 and 11 is preferably a 304 stainless steel disc having a thickness of 0.01 inches. The wire is preferably a platinum rhodium wire having a 0.003 inch diameter. The hole 151 preferably has a 0.012 inch inner diameter, which is most preferably polished using a diamond polish. The grooves 152 and 153 are preferably 0.007 inches deep to accommodate the wire. The grooves may be drilled using a No. 63 drill, which is 0.006 inches thick and modified to taper to 0.002 inches thick.

The orifice elements 154 and 150 establish an interior side 162 and an exterior side 161 for the orifice 101 and a direction of flow 163 from the interior side 162 to the exterior side 161. The conically shaped electrode 107 is disposed on the interior side 162 of the orifice for imparting a net charge to the liquid fuel traveling in direction 163. After receiving such charge, the liquid fuel flows through pull 151 and past wire 154. The liquid fuel is atomized at least partially under the influence of the net charge. The wire establishes a dual-apertured orifice 101 for the electrostatic atomizer, aperture 157 on one side of wire 154 and aperture 158 on the other side of wire 154. The relative sizes of the hole 151 and the wire 154 define apertures 157 and 158 for the orifice 101. Thus, a relatively small orifice for an electrostatic atomizer may be provided with elements that are relatively easy to assemble.

The orifice of FIG. 9 is flushed by simply providing a flow of fuel sufficient to deflect the wire 154 away from groove 152 and end 156. This action effectively enlarges hole 151 so that the fuel dislodges any debris from the orifice 101.

Variable orifices may be formed using numerous other elements. Thus, a rectangular element having an edge may form an orifice with another element having a circular aperture. An orifice may be formed at the intersection of two circular apertures, or apertures having other shapes. An inner and outer sleeve each having V-shaped notches may be used to form an orifice by balances rotary movement of both sleeves. A dual-apertured orifice may be formed by a rectangular element having two edges, similarly to the wire of FIG. 9 which divides hole 151 into apertures 157 and 158. More than two elements may be used. Several wires may be disposed across an aperture or three or more cylindrical elements having edges, notches and/or apertures of various shapes may be slidable across one another to form an orifice. Linear sliding movement between two planar elements may be used to form a variable orifice.

What is claimed is:

1. A compact stove, comprising:

a) an electrostatic atomizer for imparting a charge to a liquid fuel so that the fuel is atomized under influence of said charge, said electrostatic atomizer having a variable orifice, said orifice being variable in size;

b) a fuel source in communication with said atomizer for carrying fuel to said atomizer; and c) a support disposed above said atomizer for supporting an article to be heated by the stove.

2. The compact stove of claim 1, wherein said atomizer includes a power source.

3. The compact stove of claim 2, wherein said power source comprises an internal power source including a voltage converter and one or more batteries electrically connected to said voltage converter.

4. The compact stove of claim 3, wherein said batteries comprise three "AA" batteries.

5. The compact stove of claim 2, further comprising a catalytic member disposed above said support and adapted to catalyze combustion of the fuel.

6. The compact stove of claim 2, wherein said power source comprises an internal power source and provides a high voltage output at between about 5 and 25 kilovolts.

7. The compact stove of claim 2, wherein said power source comprises an internal power source and provides a high voltage output at between about 1 and 15 kilovolts.

8. The compact stove of claim 1, wherein said atomizer includes a plurality of orifice elements defining said variable orifice and movable relative to one another.

9. The compact stove of claim 8, wherein one of said orifice elements has a hole.

10. The compact stove of claim 9, further comprising a control knob connected to at least one of said plurality of orifice elements for controlling relative movement of said orifice elements.

11. The compact stove of claim 10, wherein said control knob is connected to a power source for electrically connecting to or disconnecting said atomizer from the power source by operation of said control knob.

12. The compact stove of claim 10, wherein said knob has a position for flushing the orifice of said atomizer with fuel.

13. The compact stove of claim 8, wherein one of said orifice elements is movable between a maximum flow position in which a relatively small orifice is defined and a minimum flow position in which a relatively large orifice is defined.

14. The compact stove of claim 1, further comprising a housing having a telescoping portion, said support being on said telescoping portion.

15. The compact stove of claim 1, wherein said atomizer includes an electrode.

16. The compact stove of claim 1, further comprising:

a) a housing; and b) a power source disposed in said housing;

c) said housing being about 91 mm in width, height and length.

17. A compact stove comprising a) a housing base and a grid movable relative to said housing base between a closed position wherein said grid is close to said housing base and a fully open position wherein said grid is remote from said housing base;

b) an electrostatic atomizer for imparting a charge to a liquid fuel so that the fuel is atomized under influence of said charge;

c) a fuel source in communication with said atomizer for carrying fuel to said atomizer; and d) a support disposed above said atomizer for supporting an article to be heated by the stove;

e) said power source comprising an internal power source including a voltage converter and one or more batteries electrically connected to said voltage converter; and f) said housing base and said grid enclosing said atomizer when said grid is in said closed position.

18. The compact stove of claim 17, wherein said fuel source comprises a pressurized fuel vessel disposed in said housing base in communication with said atomizer for storing and delivering unatomized fuel to said atomizer.

19. The compact stove of claim 18, wherein said pressurized fuel vessel includes biasing means for applying pressure to unatomized fuel in said pressurized fuel vessel, said biasing means including a latched position to prevent application of pressure to fuel in said reservoir so that no fuel flows to said atomizer.

20. The compact stove of claims 17, wherein said atomizer includes a plurality of orifice elements defining a variable orifice and movable relative to one another between a plurality of positions including a minimum flow position in which said orifice elements define a relatively small orifice and a maximum flow position wherein said orifice elements define a relatively large orifice.

21. The compact stove of claim 20, further comprising a control knob connected to at least one of said plurality of orifice elements for controlling relative movement of said orifice elements.

22. The compact stove of claim 21, wherein said control knob is connected to said power source so that said power source is electrically connected to or disconnected from said atomizer by operation of said control knob, said control knob being connected to said biasing means for releasing said biasing means from said latched position.

23. The compact stove of claim 17, wherein said grid is comprised of a catalytic material.

* * * * *

UNITED STATES PATENT AND TRADEMARK OFFICE

CERTIFICATE OF CORRECTION

PATENT NO. : 6,318,648 B1
DATED : November 20, 2001
INVENTOR(S) : Arnold J. Kelly It is certified that error appears in the above-identified patent and that said Letters Patent is hereby corrected as shown below:

Column 4,
Line 57, "is attached" should read -- are attached --
Line 61, "are attached" should read -- is attached --

Column 7,
Line 18, "50" should read -- so --

Column 8,
Line 30, "mill" should read -- mm --

Column 11,
Line 9, "claims" should read -- claim --

Signed and Sealed this

Second Day of April, 2002

*Attest:*

*Attesting Officer*

JAMES E. ROGAN
*Director of the United States Patent and Trademark Office*